United States Patent [19]

Matlock

[11] Patent Number: 4,494,685

[45] Date of Patent: Jan. 22, 1985

[54] CROSS TIE END PLATING MACHINE

[76] Inventor: Gordon E. Matlock, 544 Sappington Bridge Rd., Sullivan, Mo. 63080

[21] Appl. No.: 524,582

[22] Filed: Aug. 19, 1983

[51] Int. Cl.[3] ..... B25C 7/00; B30B 7/04

[52] U.S. Cl. ..... 227/41; 227/106; 227/152; 100/232

[58] Field of Search ..... 227/106, 152, 41; 100/232, 233, 913

[56] References Cited

U.S. PATENT DOCUMENTS

| | | | |
|---|---|---|---|
| 1,208,255 | 12/1916 | Williams | 411/457 |
| 2,260,389 | 10/1941 | Lorentzen | 227/152 |
| 2,636,525 | 4/1953 | Anguera | 227/152 |
| 3,103,701 | 9/1963 | Calchera et al. | 425/406 |
| 3,207,406 | 9/1965 | Bowman | 227/152 |
| 3,419,205 | 12/1968 | Juriet et al. | 227/152 |
| 3,540,107 | 11/1970 | Juriet et al. | 227/152 |
| 4,148,471 | 4/1979 | Werner | 269/258 |
| 4,348,850 | 9/1982 | Reeder et al. | 411/468 |
| 4,351,465 | 9/1982 | Moehlenpah et al. | 227/152 |

*Primary Examiner*—Paul A. Bell
*Assistant Examiner*—Taylor J. Ross
*Attorney, Agent, or Firm*—Zarley, McKee, Thomte, Voorhees & Sease

[57] ABSTRACT

A portable cross tie end plating machine adapted to drive a nail plate into one end of a tie. The machine is designed to end plate one end of the tie at a time after the end of the tie has been squeezed together to close the cracks therein. The tie is fed onto an infeed table on the machine and is then moved onto a pair of tie transporter arms which lower the tie downwardly into the machine onto stationary platens. A pair of movable platens squeeze one end of the tie together and a nail plate is then driven into the end of the tie by a hydraulic ram. After the nail plate has been driven into the end of the tie, the transporter arms lift the tie upwardly out of the machine and deposit the tie on the outfeed table. The machine is designed to accommodate ties up to eighteen feet in length and to accommmodate ties having various dimensions.

10 Claims, 12 Drawing Figures

CROSS TIE END PLATING MACHINE

BACKGROUND OF THE INVENTION

Cross ties for use in the railroad industry are normally formed from green wood and frequently develop splits in the ends thereof. It has been found desirable to close the splits or cracks in the ends of the tie and to then maintain the same in that condition by means of nail plates, dowels, S-irons, etc. Many prior art devices have been provided for squeezing the ends of the tie together and then driving a nail plate into the end thereof but the machines are extremely large, expensive and are not portable.

It is therefore a principal object of the invention to provide a cross tie end plating machine which is portable.

A further object of the invention is to provide a portable tie end plating machine which can accommodate ties up to approximately eighteen feet in length.

Yet another object of the invention is to provide a tie end plating machine which is economical.

Still another object of the invention is to provide a tie end plating machine which is extremely strong.

Still another object of the invention is to provide a tie end plating machine which can accommodate ties having various thicknesses.

A further object of the invention is to provide a tie end plating machine including tie transporter arms which lower the tie into position within the machine and to then raise the tie upwardly onto an outfeed table after the tie has been plated.

These and other objects will be apparent to those skilled in the art.

SUMMARY OF THE INVENTION

Figure 3:
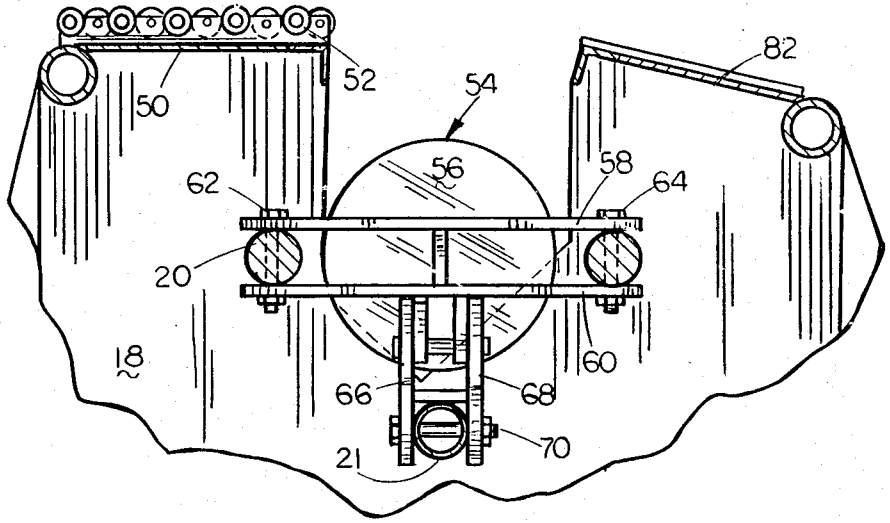
FIG. 3 is an enlarged sectional view seen on lines 3—3 of FIG. 2.
Figure 1:
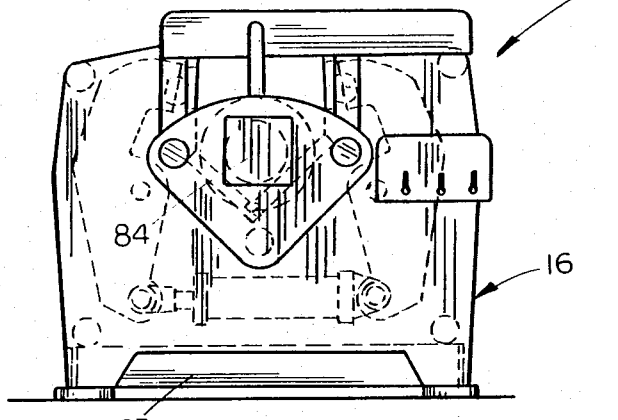
FIG. 1 is an end elevational view of the machine.
Figure 2:
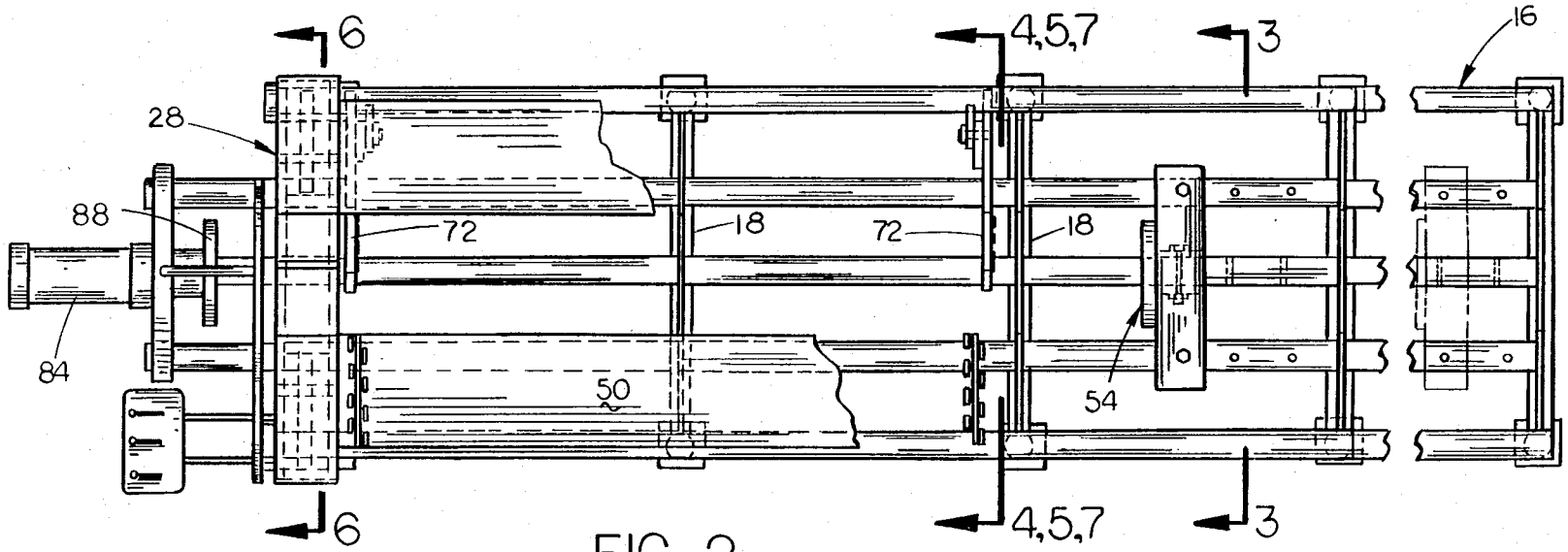
FIG. 2 is a top elevational view of the machine with portions thereof cut away to more fully illustrate the invention.
Figure 5:
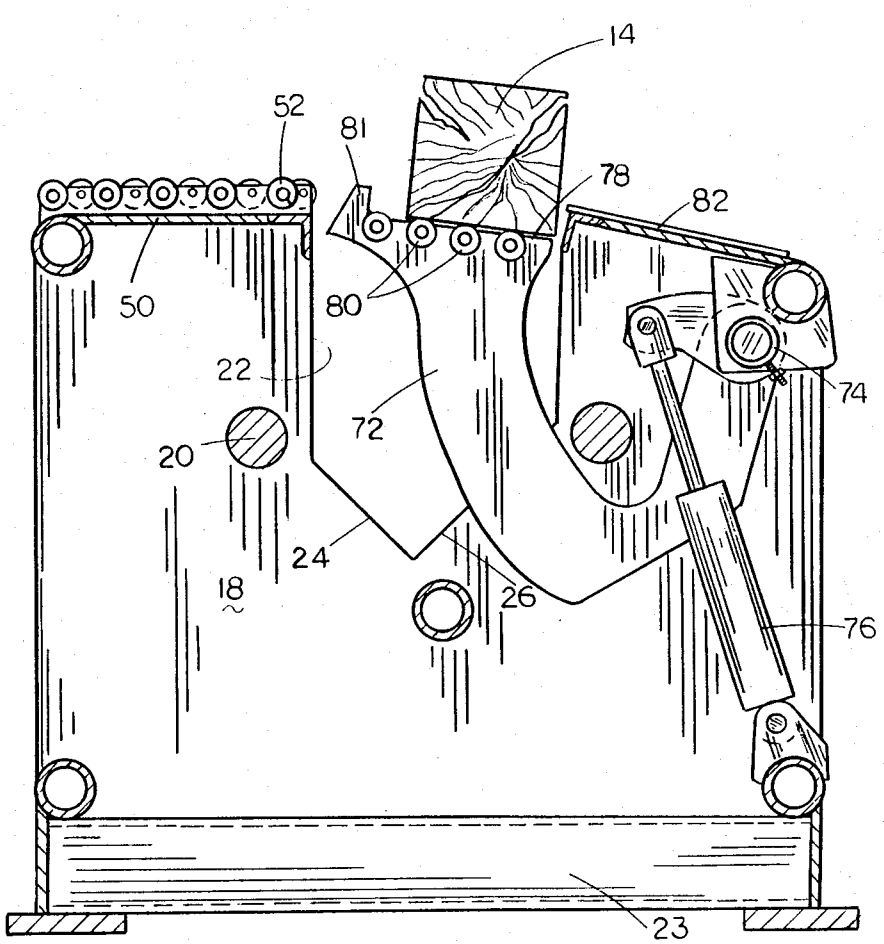
FIG. 5 is a view similar to FIG. 4 except that the transporter arms have lowered the tie downwardly into pressing position.

The tie end plating of this machine comprises a plurality of vertically disposed and horizontally spaced frame members which are joined together by means of three inch rounds extending therethrough and being secured thereto. An infeed table having rollers thereon is mounted at one side of the frame means at the upper end thereof while an outfeed or discharge table is positioned at the upper end of the frame means at the other side thereof. A pair of stationary platens are provided on the frame means at one end thereof below the tables while means is provided on the frame means for supporting the other end of the tie. A pair of movable platens are mounted on the frame means adjacent the stationary platens and are designed to squeeze the ends of the tie together to close any cracks or splits. A hydraulic ram is also provided at the end of the machine for driving a nail plate into the end of the tie after the movable platens have squeezed the end of the tie together. A transporter arm assembly is provided for lowering the tie into nailing position and for raising the same upwardly to deposit the tie onto the outfeed table. The machine can accommodate ties having various lengths and dimensions.

DESCRIPTION OF THE PREFERRED EMBODIMENT

The cross tie end plating machine of this invention is referred to generally by the reference numeral 10 while the reference numeral 12 refers to a conventional nail plate adapted to be driven into the end of the tie 14. As seen in the drawings, the ends of the tie may be split in as many as four directions.

Machine 10 generally comprises a frame means 16 comprising a plurality of vertically disposed and horizontally spaced frame members having a plurality of horizontally extending three-inch rounds extending therethrough and secured thereto. Each of the frame members 18 is provided with a cut-out portion 22 extending downwardly thereinto. The cut-out portions terminate in angularly disposed tie support portions 24 and 26 which are adapted to support the tie when it has been lowered downwardly into the machine as will be described in more detail hereinafter. The frame member 18 nearest to end 28 of machine 10 is provided with a pair of stationary platens 30 and 32 which extend upwardly and outwardly as seen in the drawings at a 45° angle to horizontal.

A pair of platen arms 34 and 36 are pivotally mounted on shafts 38 and 40 secured to the endmost frame member 18 adjacent end 28. Hydraulic cylinder 39 is pivotally connected at its rod end to arm 34 and is pivotally connected at its base end to arm 36. Platens 40 and 42 are secured to the upper ends of the arms 34 and 36 by means of swivel connections 44 and 46 respectively. Springs 48 are provided on each of the platens 40 and 42 as illustrated in the drawings to maintain the platens 40 and 42 in a position generally parallel to the exterior surfaces of the tie until the platens are brought into contact with the surfaces of the tie.

An infeed table 50 is provided at the upper end of the frame means 16 at one side of the cut-out portions 22 and has a plurality of rollers 52 mounted thereon to facilitate the movement of the tie thereacross.

The numeral 54 refers to an abutment means which is selectively longitudinally mounted on the rounds 20 to compensate for various length ties. As seen in the drawings, abutment means 54 includes a round plate 56 having attached to it a pair of spaced-apart horizontally extending bars 58 and 60 which are adapted to be secured to the rounds 20 by means of bolts 62 and 64. Abutment means 54 also includes a pair of downwardly extending bars 66 and 68 adapted to be secured to the round 20 by means of bolt 70.

A plurality of horizontally spaced-apart tie transporters 72 are pivotally mounted to frame members 18 by means of shaft 74. Hydraulic cylinder 76 is pivotally connected to each of the tie transporters 72 as illustrated in the drawings to permit the tie transporters to be moved between a lowermost position to an uppermost position. Each of the transporter arms 72 is provided with an upper end 78 having rollers 80 mounted thereon. The upper end of tie transporter 72 is also provided with an upwardly extending ear 81.

Figure 4:
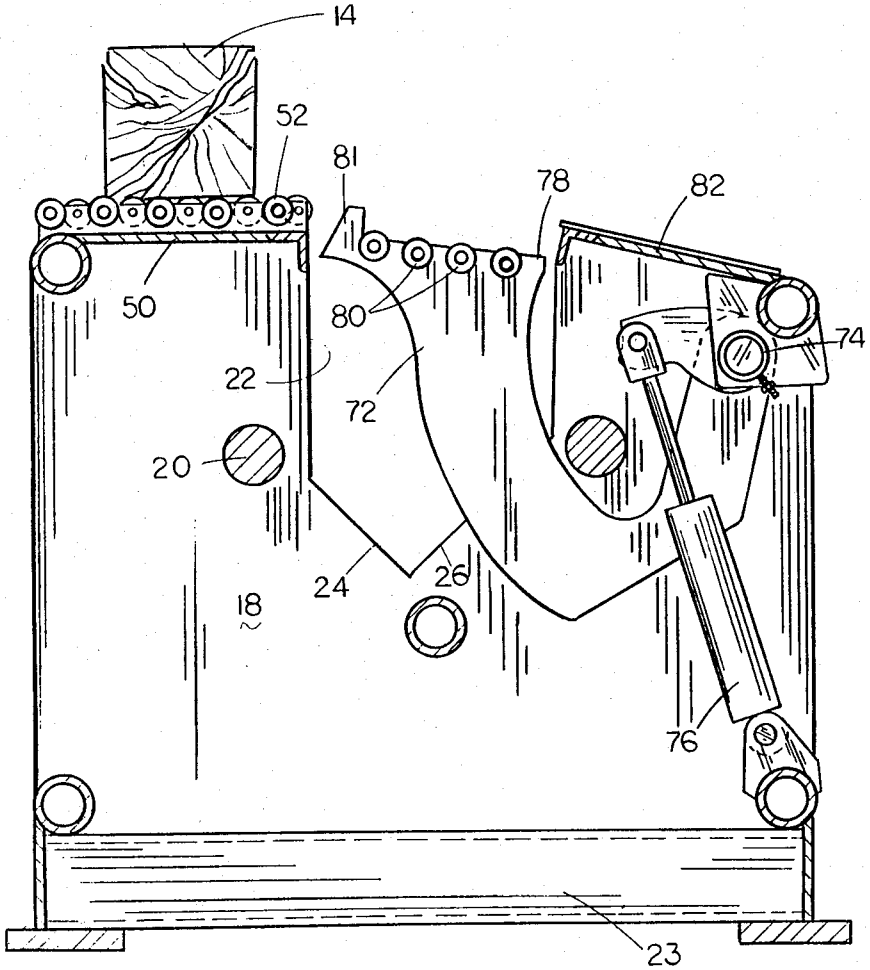
FIG. 4 is a sectional view seen on lines 4—4 illustrating a tie being received on the transporter arms.
Figure 6:
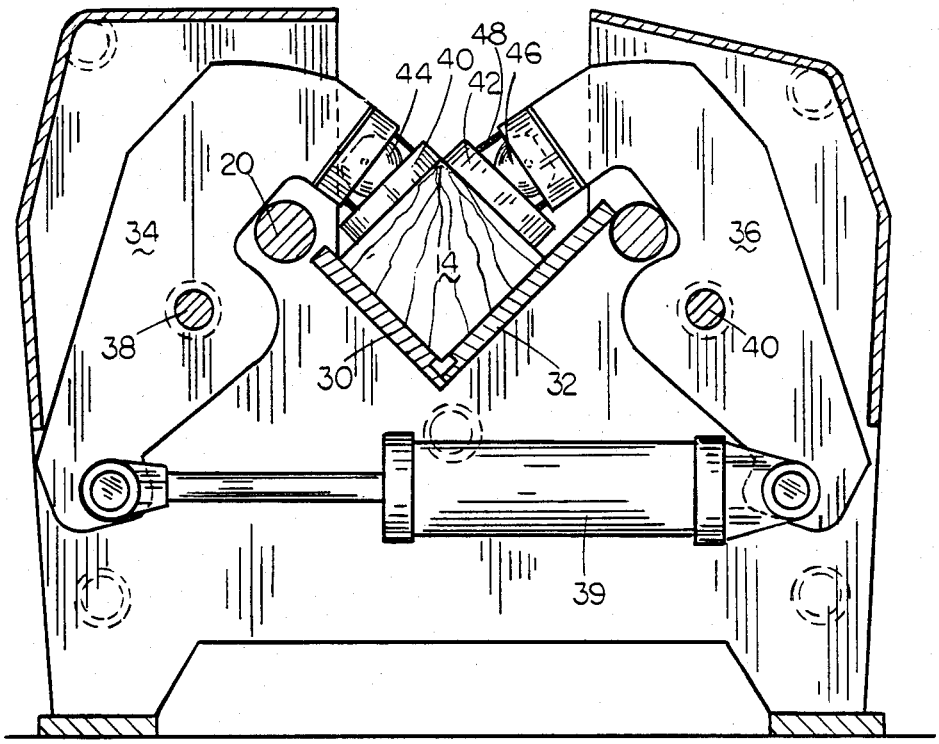
FIG. 6 is a view similar to FIGS. 4 and 5 but which illustrates the pressing platens engaging the tie.

Frame means 16 is also provided with an outfeed or discharge table 82 which is disposed in an inclined position as best illustrated in FIG. 4.

Figure 11:
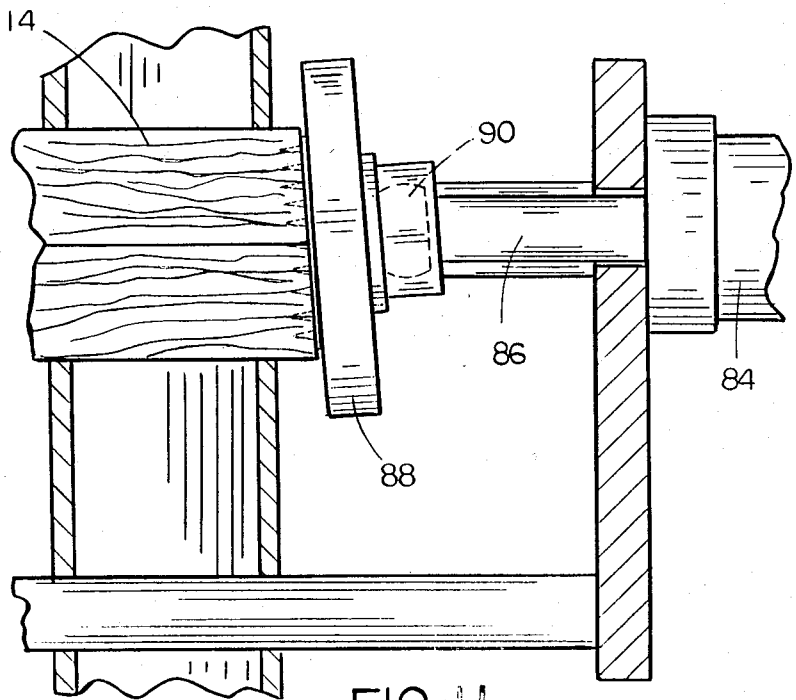
FIG. 11 is a view similar to FIG. 9 illustrating the hydraulic ram driving the nail plate into the end of the tie.
Figure 8:
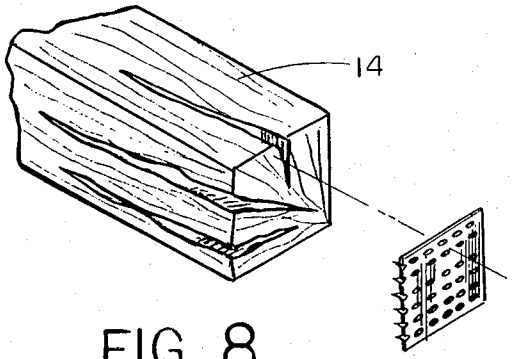
FIG. 8 is a perspective view illustrating the relationship of a nail plate and the tie prior to the nail plate being mounted thereon.
Figure 10:
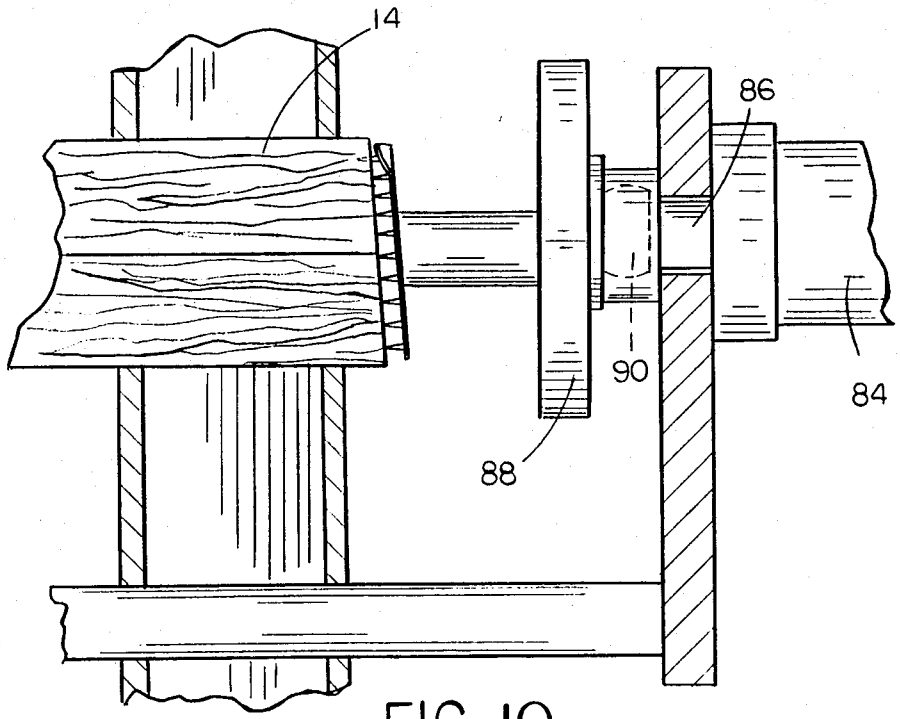
FIG. 10 is a perspective view illustrating the nail plate driven into the end of the tie.
Figure 12:
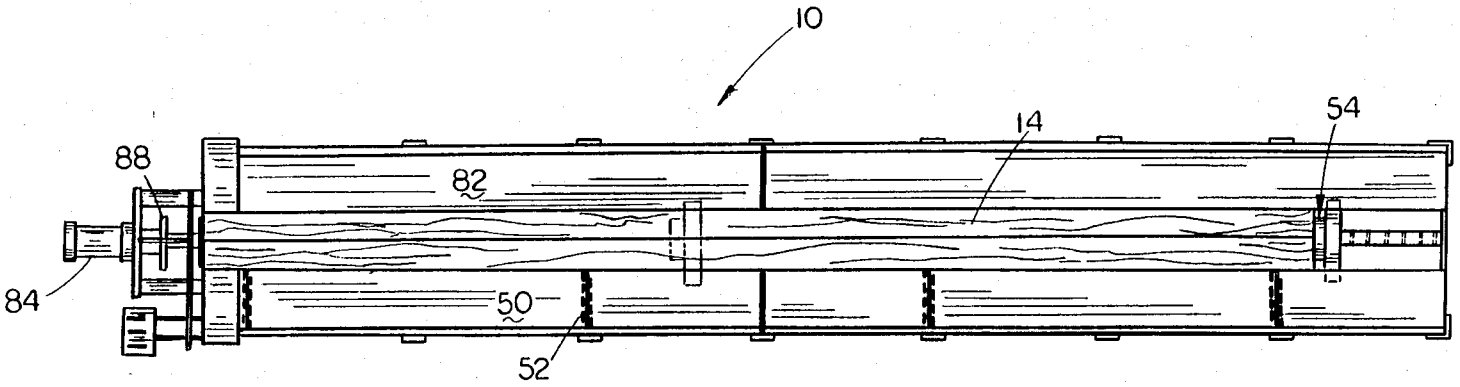
FIG. 12 is a top view of the machine illustrating the machine accommodating a tie of approximately eighteen feet long with the broken lines illustrating an alternate position of the abutment means.

Mounted at end 28 of machine 10 is a power ram or cylinder 84 having a cylinder rod 86 extending therefrom. A pressing platen 88 is mounted by means of a swivel connection 90 on the end of the rod 86 as best seen in FIGS. 10 and 11 so that the pressing platen can adjust to irregular ends of the tie.

The normal method of operation is as follows. The hydraulic cylinder 39 is initially in a retracted position as is the hydraulic cylinder 84. The hydraulic cylinders 76 would normally be in the position illustrated in FIG. 4 so that the upper end of the ear 81 is positioned relative to the rollers 52 on infeed table 50 as best illustrated in FIG. 4. A tie 14 is then placed on the infeed table 50 and pushed or fed onto the rollers 80 on transporter arms.72. The inner end of outfeed table 82 will prevent the tie from moving onto the outfeed table 82 at this time. The hydraulic cylinders 76 are then retracted to cause the transporter arms 72 to pivotally move from the position illustrated by broken lines in FIG. 7 to the lowermost position illustrated by solid lines in FIG. 7. The lowering of the abutment arms 72 by the hydraulic cylinders 76 causes one end of the tie 14 to be positioned on the stationary platens 30 and 32 and the remainder of the length of the tie to be supported on the tie support portions 24 and 26 on the frame members 18. Hydraulic cylinder 39 is then actuated to cause the extension thereof so that the platen arms 34 and 36 pivot about rounds 38 and 40 so that the platens 40 and 42 engage the tie 14 as illustrated in the drawings. The swivel connections between the platens 40 and 42 and the arms 34 and 36 permit the platens to compensate for irregular exterior surfaces of the tie. Continued extension of the cylinder 39 causes the end of the tie to be squeezed together to close any cracks or splits therein. One corner of the nail plate 12 is then tacked onto the end of the tie 14 if the plate had not previously been tacked thereto. Hydraulic cylinder 84 is then actuated to cause the extension of rod 86 so that the pressing platen 88 drives the nail plate 12 into the end of the tie as illustrated in the drawings. The force of the pressing platen against the tie will move the tie lengthwise somewhat until the other end of the tie engages the abutment means 54 which prevents further movement of the tie. The abutment means may be adjustably mounted on the frame means so that it may accommodate various tie lengths. In fact, the abutment means 54 may be adjusted so that it can accommodate switch ties having lengths of approximately eighteen feet and could be longer if required.

Figure 7:
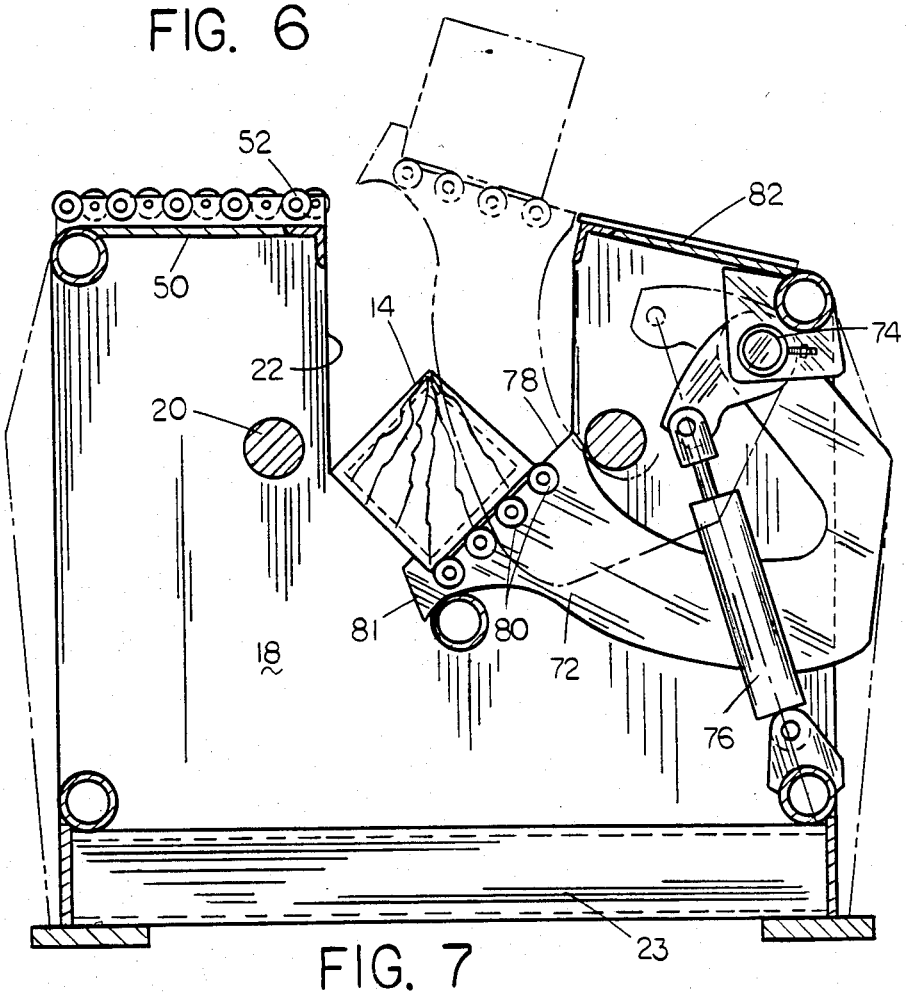
FIG. 7 is a view similar to FIG. 4 but which illustrates the transporter arms lifting the tie upwardly from the machine.
Figure 9:
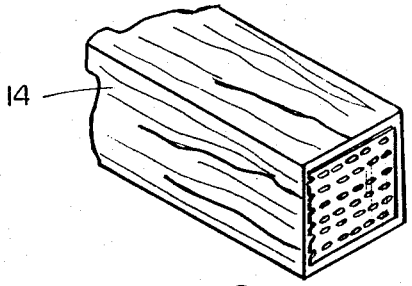
FIG. 9 is a top view illustrating the hydraulic ram about to drive the nail plate into the end of the tie.

After the pressing platen 86 has driven the nail plate 12 into the end of the tie as previously described, hydraulic cylinder 84 is retracted to move the pressing platen back to the position of FIG. 7. Hydraulic cylinder 39 is then retracted to move the platens 40 and 42 out of engagement with the tie. Hydraulic cylinders 76 are then extended which causes the transporter arms 72 to pivotally move upwardly thereby moving the tie 14 upwardly. The transporter arms 72 are pivotally moved upwardly until the lower end of the tie 14 is positioned above the outfeed table 82. Rollers 80 then cause the tie 14 to roll onto the outfeed table 82. The tie 14 is then slidably removed from the outfeed table 82. Several ties would be plated as described. When sufficient ties have accumulated, the ties would be taken to the infeed side of the machine and reversed so that the other ends of the ties may be plated.

There are several features of the machine which deserve further elaboration. The structure of the frame means is extremely important in that an extremely strong machine is provided while yet being lightweight. The strength of the machine is accomplished by means of the rounds 20 extending through the center of the machine slightly above the center of the tie as it is positioned in the nailing position. The interconnection of the frame members 18 by the rounds 20 and pipes 21 as well as the cross frames 23 does result in a machine which is very strong.

A further advantage of the machine 10 is the free floating aspect of the cylinder 39. The free floating mounting of the cylinder 39 causes the platens 40 and 42 to "seek" the size of the tie so that the proper pressure is applied thereto.

Although the machine is described as being able to plate one end of the tie at a time, it should be appreciated that a hydraulic ram similar to hydraulic ram 84, compression arms 34 and 36 could be positioned at the other end of the tie if so desired. However, the preferred embodiment is to provide only a single hydraulic ram due to cost considerations.

I claim:

1. An end plating machine for an elongated wood cross tie, comprising, a frame means having upper and lower portions, and opposite ends, first and second stationary platens adjacent one end of said frame means, said first and second stationary platens being positioned adjacent and transversely to each other, means on said frame means spaced longitudinally from said first and second stationary platens for supporting the other end of the tie, said first and second stationary platens dwelling in planes which are approximately 45° from horizontal so as to horizontally support one end of the tie in a diagonal position with the surfaces of the tie being disposed approximately 45° from horizontal so that the tie has a pair of upper surfaces and a pair of lower surfaces, first and second platen arms having upper and lower ends, said first platen arm being pivotally mounted, between its upper and lower ends, to said frame means adjacent one side thereof laterally of said first stationary platen, said second platen arm being pivotally mounted, between its upper and lower ends, to said frame means adjacent the other side thereof laterally of said second stationary platen, first and second movable platens on the upper ends of said first and second platen arms respectively, a power cylinder means pivotally secured to and extending between the lower ends of said first and second platen arms so that said first and second movable platens may be brought into contact with the upper surfaces of the tie and to squeeze the same to substantially close any cracks in the end of the tie, a horizontally disposed power ram means at said one end of said frame means for forcing a nail plate into the end of the tie after the first and second movable platens have closed the cracks in the end of the tie, and an abutment means on said frame means spaced from said one end thereof for limiting the longitudinal movement of the tie as said ram means forces the nail plate into the end of the tie.

2. The machine of claim 1 wherein said abutment means is selectively longitudinally movably mounted on said frame means to permit the machine to accommodate ties of various lengths.

3. The machine of claim 2 wherein said frame means can accommodate ties having lengths up to approximately eighteen feet.

4. The machine of claim 1 wherein said movable platens are swivel mounted on said arms.

5. The machine of claim 1 wherein said power ram means has a swivel plate thereon for engaging the end of the tie.

6. The machine of claim 1 wherein said frame means comprises a plurality of vertically disposed and horizontally spaced frame members, and a plurality of horizontally extending round bars extending through and secured to said frame members.

7. The machine of claim 1 wherein said frame means has a tie infeed table at its upper end adjacent its said one side.

8. The machine of claim 1 wherein a pair of horizontally spaced tie transporter arms are pivotally mounted, about a horizontal axes, to said frame means, said tie transporter arms adapted to receive the tie from the infeed table, lower the tie onto the stationary platens, and raise the tie from the stationary platens after the nail plate has been mounted on the end of the tie.

9. The machine of claim 8 wherein said frame means has a tie outfeed table at its upper end adjacent its said other side.

10. The machine of claim 9 wherein said transporter arms deliver the tie onto said outfeed table.

* * * * *